United States Patent [19]

Dallaire

[11] 4,253,278

[45] Mar. 3, 1981

[54] ROLLER DEVICE FOR A SLIDING CLOSURE

[75] Inventor: Raymond Dallaire, St. David, Canada

[73] Assignee: P. H.-Tech., Inc., Levis, Canada

[21] Appl. No.: 33,849

[22] Filed: Apr. 27, 1979

[30] Foreign Application Priority Data

Mar. 20, 1979 [CA] Canada ..... 323829

[51] Int. Cl.[3] ..... E05D 13/02

[52] U.S. Cl. ..... 49/420; 16/105

[58] Field of Search ..... 49/420, 425; 16/105

[56] References Cited

U.S. PATENT DOCUMENTS

| | | | |
|---|---|---|---|
| 1,448,845 | 3/1923 | Johnson et al. | 49/420 X |
| 3,281,993 | 11/1966 | Riegelman | 49/425 |
| 3,341,973 | 9/1967 | Miller | 49/420 |

FOREIGN PATENT DOCUMENTS

| | | | |
|---|---|---|---|
| 1272159 | 5/1964 | Fed. Rep. of Germany | 16/105 |

*Primary Examiner*—Kenneth Downey

*Attorney, Agent, or Firm*—Howson and Howson

[57] ABSTRACT

A roller device for a sliding closure of the type which permits adjustment of the effective height of the sliding closure relative to its support frame after the closure has been installed within the frame is described. The device comprises first and second members adapted for sliding engagement within a channel of a side of the sliding closure, said members being connected by resilient means, the first member being adapted for removable, secure attachment to the sliding closure, the position of the second member being slidingly adjustable relative to the first member, the second member being adapted to slide along a track associated with an aperture within which the sliding closure can be installed and a recessed roller mounted for rotation within the second member for rolling along a top edge of the track.

9 Claims, 7 Drawing Figures

ROLLER DEVICE FOR A SLIDING CLOSURE

This invention relates to a roller device for a sliding closure of the type which permits adjustment of the effective height of the sliding closure relative to its support frame after the closure has been installed within the frame.

There have been described numerous roller devices for sliding closures. Examples can be seen in U.S. Pat. No. 3,670,357 issued June 20, 1972 to Steigerwald, Canadian Pat. No. 979,737 issued Dec. 16, 1975 to Truth Incorporated, Canadian Pat. No. 791,994 issued Aug. 13, 1968 to Daryl Industries, Inc. and U.S. Pat. No. 3,298,136 issued Jan. 17, 1967 to Saunders.

Generally in the prior art devices, the outward displacement of the roller device from the edge of the closure is quite substantial, so that mounting and dismounting of the closure can be a troublesome procedure. One of the most common problems with prior roller systems is that when one raises the closure upwards, there is not enough room at the top and at the same time the bottom roller keeps dropping towards the sill and stays engaged. Thus, either two pairs of hands are required or in frustration, one kicks or forces out the bottom of the closure, breaking the roller frequently and/or the mounting system. Further, usually the roller itself must be inwardly displaced during mounting and dismounting, and since the roller is usually mounted for rotation and there is inherently a certain amount of play associated with this type of mounting, wear and tear to and damage of the roller is increased in this manner. Additionally, the prior art devices are not located at the corners of the sliding closure so that on sliding of the closure back and forth along the track, the closure will frequently tilt and jam or derail. This occurs particularly when the track is blocked with dirt or debris. Aside from these problems the individuals who handle the installation of such closure devices are relatively unskilled and therefore there is a constant desire on the part of manufacturers to develop a roller device which is not only cheaper, more reliable and easier to manufacture, but also more easily and quickly installed, i.e. a foolproof roller device.

Thus the present invention provides a roller device for a sliding closure comprising first and second members adapted for sliding engagement within a channel of a side of the sliding closure, said members being connected by resilient means, the first member being adapted for removable, secure attachment to the sliding closure, the position of the second member being slidingly adjustable relative to the first member, the second member being adapted to slide along a track associated with an aperture within which the sliding closure can be installed and a recessed roller mounted for rotation within the second member for rolling along a top edge of the track.

The present roller device is adapted to be mounted at the corners of a sliding closure in a horizontally sliding closure. In position, the channelled edges of the second member project outwardly of the top and bottom edges of the sliding closure, and when the closure is mounted for sliding within an upper and lower track, the channelled edges straddle the sides of the track while the roller rolls along the top edge. The channelled edges not only permit easy mounting of the track but also sweep the channel free of dirt and debris permitting smooth sliding of the closure. The second member is adapted for reciprocal movement within the channel, moving against the resilient means and the secured first member during the operations required for mounting and dismounting of the sliding closure. In addition to these advantages the present roller device is also easy to install and replace, requiring a single screw to attach it to the closure. The device is adjustable once mounted in the closure and once the closure is mounted within an aperture. Further, the device is reliable and relatively durable. In addition, the recessed roller can also be replaced in the event it becomes defective without the necessity of replacing the complete roller device.

Preferably the roller device is made of a nylon type polymer plastic, although any other plastic material having the same properties could be employed.

Preferably, the resilient means comprises an adjustable, spring-loaded link which in turn preferably comprises a threaded bolt and nut with a coiled spring fitted over the shank of the bolt, the head of the bolt extends from the first member and the end of the bolt rests in the second member, and the nut is located within the second member so that the spring is under compression between both members.

The first member can be adapted for removable, secure attachment to the sliding closure by providing a U-shaped slot for receiving a screw located in the sliding closure on installation of the device within the channel of the sliding closure.

The second member can be adapted to slide along a track associated with an aperture by providing a channel within the member, the sides of which are reinforced to permit the device to slide along the track. The reinforcement of the sides of the channel insures that the device can be subjected to the various stresses and pressures associated with removal of the closure from the aperture.

As indicated previously, the roller is recessed within the second member and preferably the roller is recessed within the channel provided therein.

The recessed roller is preferably formed with a semicircular shaped groove for engaging the top edge of the track along which it rolls.

When the roller device is installed in a sliding closure, the head of the bolt is positioned so that it is accessible for adjustment. The best way for insuring such accessability has been found to be to angle the bolt between the two members, with the head of the bolt lying adjacent the edge of the sliding closure.

Prior to installation of the closure within an aperture, the roller device is located within the channel so that the sides of the channel formed in the second member project outwardly of the sliding closure. The position of the roller device within the channel is determined both by the location of the screw by which the first member is secured to the closure and the compression set on the spring-loaded link. When the sliding closure has been installed within an aperture, the spring-loaded link is accessible for adjustment as has been described earlier.

In the drawings which illustrate a preferred embodiment of the present invention;

Figure 1:
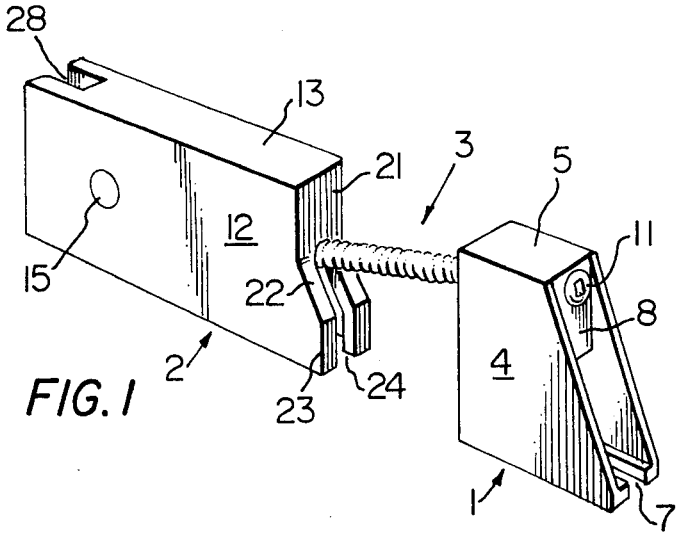
FIG. 1 is a perspective view of a roller device of the present invention.
Figure 2:
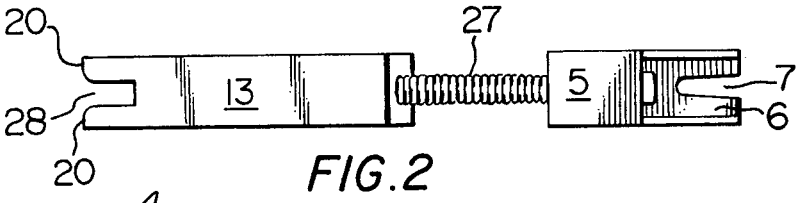
FIG. 2 is a top view of the device of FIG. 1.
Figure 3:
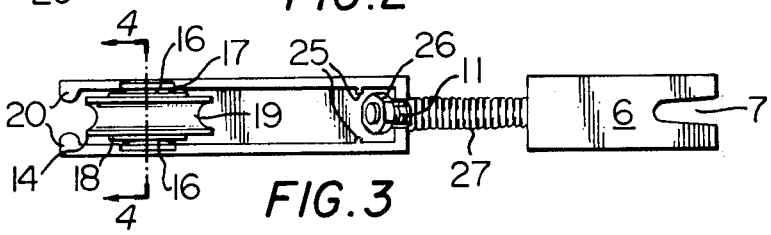
FIG. 3 is a bottom view of the device of FIG. 1.

Referring first to FIGS. 1 to 5, the structure of the roller device can be seen. The device comprises a first member, designated generally at 1, a second member designated generally at 2, and an adjustable, spring-loaded link designated generally at 3.

The first member 1 comprises a pair of side walls 4 connected by a top wall 5 and a bottom wall 6. The bottom wall 6 is provided with a substantially U-shaped slot 7. A wall 8 extends between side walls 4 from the edge of top wall 5. The wall 8 is provided with an aperture through which a threaded bolt 11 is fed. The wall 8 is angled to the vertical so that the head of the bolt 11 in this case having a Roberston head, is accessible from the outer side of the first member, eg. by means of a screw driver. The wall 8 stops about the mid-region of the side walls and extends at an angle which lies in a plane substantially parallel to the plane in which the bolt 11 lies and continues towards the lower ends of the side walls 4 forming a wall 9 which terminates in a vertical wall 10. The wall 10 joints the lower ends of the side walls 4 in the end of the bottom wall 6.

Figure 4:
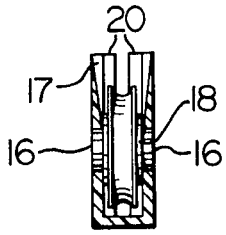
FIG. 4 is a section on line 4—4 of FIG. 3.
Figure 5:
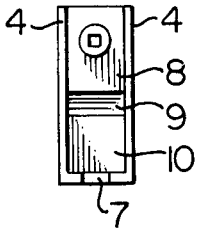
FIG. 5 is an end view of the device of FIG. 1 showing a bolt head.

The second member 2 comprises a pair of side walls 12 joined together at their vertical edges by top wall 13. Side walls 12 provide support means by virtue of apertures 15 for a roller 14. The apertures receive axle 16 of roller 14. Roller 14 freely rotates within these apertures. Side walls 12 are thinned progressively away from each aperture 15 towards the bottom edges of the second member 2 to provide slots 17 which act as guides for the roller 14 to snap easily into and out of the apertures 15 on slight flexing of the side walls 12. These slots are best seen in FIG. 4.

An end wall 21 joins the side walls 12 and the top wall 13. The end wall 21 extends perpendicularly from the edge of the top wall 13 to a region just over $\frac{1}{3}$ towards the opposite edge. At this point, the wall slopes outwardly for about the same distance to form a wall portion 22 and then again extends perpendicularly to form a wall portion 23. A substantially U-shaped vertical slot 24 is provided in wall portions 22 and 23. This slot 24 receives the end of bolt 11.

On the interior portions of side walls 12, adjacent end wall 21, there is provided a pair of thin, vertical projections 25 which serve as an aligning guide for locating nut 26 during assembly of the device. In addition, the flat-to-flat diameter of the nut is chosen to be equivalent to the distance between side walls 12 so that the nut is secured against rotation when the bolt is being turned.

The adjustable spring-loaded tension link 3 comprises the threaded bolt 11, a nut 26 and a coiled spring 27 which fits over the shank of bolt 11. As has been described earlier, the head of bolt 11 is located in an aperture in the wall 8 of the first member 1 and extends through slot 24 in wall portions 22 and 23 of the second member 2. The coiled spring 27 lies between the first and second members. The end of bolt 11 lies in the slot 24 with a nut 26 located on the end of the bolt 11 within the outer member between the end wall and the vertical projections 25.

Roller 14 is preferably formed integrally with the central axle 16 about which it rotates. Obviously the roller 14 can be formed of several parts, eg. an axle and a wheel. A pair of integrally formed circular flanges 18 are provided between the axle 16 and the roller. This flange spaces the roller from the side walls thus permitting free and easy rotation of the roller. The roller 14 is provided with a semi-circular groove 19 on its outer edge which permits the roller to engage the upper edge of a track located in a window or door aperture.

A U-shaped opening 28 is provided in the edge of top wall 13 remote from the first member and together with the adjacent edges of side walls 12, which edges are thickened to provide reinforcement, form a channel for sliding along and straddling the track associated with the door or window aperture. This channel permits easy mounting and dismounting of the closure since the track is readily located thereby.

Figure 6:
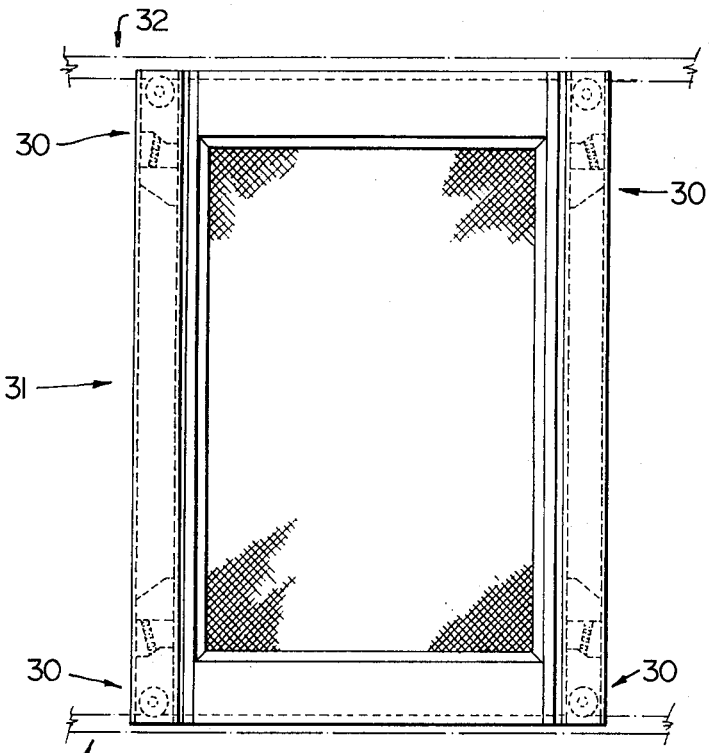
FIG. 6 is a view of a sliding screen closure with four roller devices shown in phantom.
Figure 7:
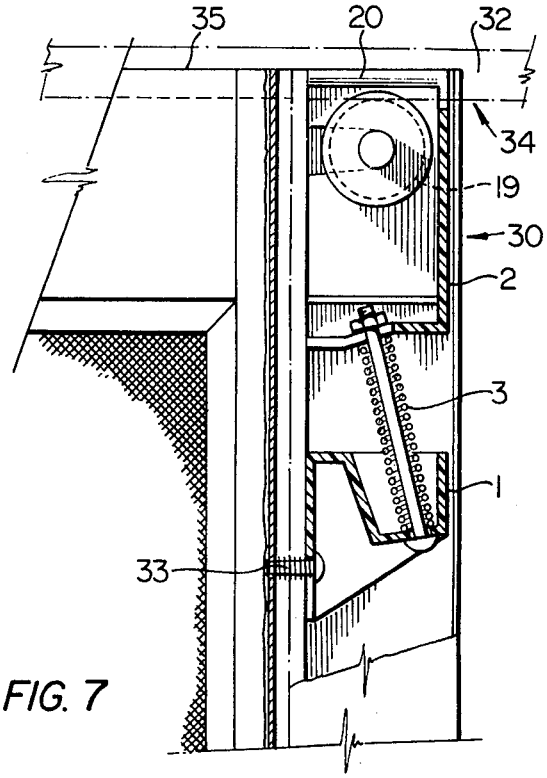
FIG. 7 is an enlarged-partially sectioned view of a corner of the closure of FIG. 6 with a portion of the frame broken away and showing a roller device in position.

Referring now to FIGS. 6 and 7 wherein four roller devices, designated generally at 30 an be seen installed in a sliding closure designated generally at 31, which in this case is a conventional sliding screen closure, and the sliding screen closure is installed within upper and lower tracks designated generally at 32. Obviously conventional window sliding closures can employ the present roller device.

The roller device 30 is secured to the sliding closure 31 by a screw 33. When the sliding closure 31 is installed the groove 19 in the roller 14 rides along the top edge 34 of track 32. The edges 20 of the second member 2 straddle the track 32 and by virtue of the adjustment on the spring-loaded link 3 and the combination of a roller device at each corner of the sliding closure, the closure is held in place on the track under tension with the second member being compressed against the spring-loaded link 3 and the first member 1.

To remove the closure from the track, the closure is forced vertically upwardly or downwardly whereby the second member 2 is further compressed towards the first member 1 to the extent that the outwardly projecting edges 20 of the second member of the opposite edge of the screen can clear the top edge of the associated track to permit removal of the sliding screen closure.

The roller devices located at the four corners of the closure permit relatively trouble-free sliding of the closure along the track. Further the projecting edges 20 of the opposite member serve to clear the track of any dirt or debris and thereby allow the roller to roll freely along the top of the track.

The embodiments of the invention in which an exclusive property or privilege is claimed are defined as follows:

1. A roller device for a sliding closure of the type having a channel along at least one side thereof, comprising:

first and second members in said channel and adapted for sliding engagement therein;

spring means connecting together said first and second members;

said first member being adapted for removable, secure attachment to said sliding closure;

the position of said second member being slidingly adjustable relative to said first member;

said second member being adapted to slide along a track associated with an aperture within which said sliding closure can be installed; and a recessed roller mounted for rotation within said second member for rolling along a top edge of a track;

wherein said spring means comprises an adjustable spring-loaded link extending between said first and second members for maintaining said spring means under compression so as to limit the maximum outward position of said second member, said spring-loaded link comprising a threaded bolt and nut with a coiled spring fitted over the shank of said bolt, the head of said bolt extending from said first member and the end of said bolt resting in said second member with said nut located within said second member so that said spring lies under compression between said first and second members.

2. A roller device as claimed in claim 1 wherein the first member is provided with a U-shaped slot for receiving a screw located in the sliding closure on installation of the device within the channel of the sliding closure.

3. A roller device as claimed in claim 1 wherein the second member is provided with a channel, the sides of which are reinforced to permit the device to slide along a track.

4. A roller device as claimed in claim 3 wherein the roller is recessed within the channel of said second member.

5. A roller device as claimed in claim 1, 3 or 4 wherein the roller is provided with a semi-circular shaped groove for engaging the top edge of the track.

6. A roller device as claimed in claim 1 wherein the head of the bolt is positioned so that it is accessible for adjustment when the device is installed in the sliding closure.

7. A roller device as claimed in claim 1 wherein the device is adapted for sliding engagement within a channel of a vertical side of a horizontally sliding fourcornered closure and a device is located at each corner of said closure.

8. A roller device as claimed in claim 3 wherein the sides of the channel of said second member project outwardly of the sliding closure prior to installation of the closure within an aperture and the extent of such projection is determined both by the location of the screw by which the first member is secured to the closure and the compression on the spring-loaded link.

9. A roller device as claimed in claim 8 wherein the spring-loaded link is accessible for adjustment when the closure device has been installed.

* * * * *